US006997283B2

(12) United States Patent
Wollenberg et al.

(10) Patent No.: US 6,997,283 B2
(45) Date of Patent: Feb. 14, 2006

(54) LADDER STABILIZER ATTACHMENT APPARATUS AND METHODS

(75) Inventors: Skye Lechner Wollenberg, Seattle, WA (US); Neil Garrett Stockman, Des Moines, WA (US)

(73) Assignee: Trade Associates, Inc., Kent, WA (US)

( * ) Notice: Subject to any disclaimer, the term of this patent is extended or adjusted under 35 U.S.C. 154(b) by 0 days.

(21) Appl. No.: 10/734,736

(22) Filed: Dec. 12, 2003

(65) Prior Publication Data

US 2004/0206575 A1 Oct. 21, 2004

Related U.S. Application Data

(63) Continuation-in-part of application No. 10/272,227, filed on Oct. 15, 2002, now abandoned.

(51) Int. Cl.
*E06C 7/06* (2006.01)
*E06C 7/14* (2006.01)
*E04G 5/02* (2006.01)

(52) U.S. Cl. ..... 182/214; 182/107; 248/210

(58) Field of Classification Search ..... 182/107, 182/214, 129, 121, 200–205, 206; 248/210, 248/211, 238, 235
See application file for complete search history.

(56) References Cited

U.S. PATENT DOCUMENTS

| | | | | |
|---|---|---|---|---|
| 1,980,854 A | | 11/1934 | Eberle | 248/238 |
| 3,027,968 A | | 4/1962 | Ouellette | 182/201 |
| 3,937,298 A | | 2/1976 | Hurwitz | 182/200 |
| 4,061,203 A | | 12/1977 | Spencer et al. | 182/214 |
| 4,159,045 A | | 6/1979 | Brooks | 182/116 |
| 4,184,569 A | | 1/1980 | Grenier | 182/206 |
| 4,249,638 A | | 2/1981 | Fernandez | 182/201 |
| 4,359,138 A | * | 11/1982 | Kummerlin et al. | 182/214 |
| 4,412,599 A | | 11/1983 | McCrudden et al. | 182/201 |
| 4,502,566 A | * | 3/1985 | Wing | 182/214 |
| 4,932,498 A | * | 6/1990 | Miller | 182/214 |
| 5,117,941 A | | 6/1992 | Gruber | 182/107 |
| 5,121,814 A | | 6/1992 | Southern | 182/214 |
| 5,242,031 A | * | 9/1993 | Ashley | 182/214 |
| 5,261,507 A | * | 11/1993 | Williams et al. | 182/214 |
| 5,850,894 A | | 12/1998 | Busenhart | 182/214 |
| 6,250,424 B1 | | 6/2001 | Laug | 182/107 |

* cited by examiner

*Primary Examiner*—Hugh B. Thompson, II
(74) *Attorney, Agent, or Firm*—Dorsey & Whitney LLP

(57) ABSTRACT

Ladder attachment apparatus and methods are disclosed. In one embodiment, an attachment apparatus for a ladder includes a main support adapted to be coupled to the ladder approximately parallel to the rungs. The main support includes a first coupling member proximate a first one of the elongated rails of the ladder and a second coupling member proximate another one of the elongated rails. The attachment apparatus further includes first and second support modules removeably coupled to the first and second coupling members, respectively. Each support module includes a support member including a proximal end and a distal end, and a support arm attached to the support member proximate the distal end and projecting outwardly therefrom in a first direction. The support member includes at least one projecting portion that is removeably coupleable to the corresponding one of the first and second coupling members.

23 Claims, 12 Drawing Sheets

LADDER STABILIZER ATTACHMENT APPARATUS AND METHODS

CROSS-REFERENCE TO RELATED APPLICATION

This application is a continuation-in-part of pending U.S. patent application Ser. No. 10/272,227, filed Oct. 15, 2002 now abandoned.

TECHNICAL FIELD

The present invention relates to equipment for improving and extending the usefulness of a ladder, and more particularly, to ladder stabilizer attachment apparatus and methods.

BACKGROUND OF THE INVENTION

Ladders are a ubiquitous tool used in a wide variety of industrial and domestic environments. Ladders are an important tool, for example, in the construction trades. Ladders are also commonly found in homes, schools, and offices to facilitate repairs or the performance of routine maintenance, such as the trimming of trees, and the changing of light bulbs or signage. Ladders also serve highly useful purposes for firefighting and the maintenance of public utilities. Indeed, it is difficult to imagine life without ladders.

Some ladders, typically referred to as step ladders, are capable of standing alone to support a user. Another type of ladder, however, does not stand alone, but rather, must be leaned against a wall or other structure in order to support a user. Ladders of this type include extension ladders. Alternately, some step ladders may be used in a stand alone mode, or may be folded and leaned against a wall during use.

One disadvantage of ladders that must be leaned against a wall to support a user is that when the lower end of the ladder is positioned in a desired location by the user, the upper end of the ladder may coincide with a relatively fragile structure, such as a window or a rain gutter, that cannot support the weight of the user when the user climbs the ladder. Another disadvantage is that the upper end of the ladder may contact a portion of the wall that the user desires to paint or access. In such situations, the user must typically relocate the lower end of the ladder to a less desirable position to avoid the disadvantages associated with the position of the upper end, with the result that the user may be required to reach or lean away from the ladder to perform the desired task at the upper end of the ladder.

It is known to use various ladder attachment structures in an attempt to overcome some of the above-noted disadvantages. For example, U.S. Pat. No. 5,117,941 issued to Gruber teaches that a pair of brackets may be attached to the tips of the rails of the ladder, and a spacer member of sufficient length to span a window opening may be attached to the brackets in a cross-wise fashion to avoid having the tips of the rails of the ladder contact the window. Alternately, Gruber teaches that a platform may be attached to the brackets to provide a standoff from the wall. Similarly, U.S. Pat. No. 4,184,569 issued to Grenier teaches a pair of tubes or bars that are attached to the rails of the ladder that project outwardly toward the wall, providing a standoff between the upper end of the ladder and the wall. U.S. Pat. No. 4,159,045 issued to Brooks teaches a platform that is bolted to the rails that projects outwardly to provide the desired standoff. A similar apparatus is taught by Busenhart (U.S. Pat. No. 5,850,894) for operation of a ladder near interior or exterior corners of a building.

Although useful results have been achieved using the prior art attachment apparatus, some disadvantages exist. For example, prior art apparatus are characterized by being rigidly attached and not easily disassembled from the ladder. It is therefore no easy matter to remove such attachment apparatus from a ladder when it is no longer desired, or to facilitate storage and transportation of the ladder. Also, the prior art attachment apparatus are generally characterized as being relatively non-adjustable and having only a single operating position. Although some prior art attachment apparatus may be moved to different locations on the ladder, there is little or no ability to easily and efficiently change the configuration of the attachment apparatus to accommodate varying situations in which a standoff from the wall may be needed.

SUMMARY OF THE INVENTION

The present invention is directed to equipment for improving and extending the usefulness of a ladder, and more particularly, to ladder stabilizer attachment apparatus and methods. In one aspect, an attachment apparatus for a ladder includes a main support adapted to be coupled to the ladder approximately parallel to the rungs. The main support includes a first coupling member proximate a first one of the elongated rails of the ladder and a second coupling member proximate another one of the elongated rails. The attachment apparatus further includes first and second support modules removeably coupled to the first and second coupling members, respectively. Each support module includes a support member including a proximal end and a distal end, and a support arm attached to the support member proximate the distal end and projecting outwardly therefrom in a first direction. The support member includes at least one projecting portion that is removeably coupleable to the corresponding one of the first and second coupling members.

DETAILED DESCRIPTION OF THE INVENTION

The present disclosure is generally directed toward novel modular spray gun apparatus and methods. Many specific details of certain embodiments of the invention are set forth in the following description and in FIGS. 1–19 to provide a thorough understanding of such embodiments. One skilled in the art will understand, however, that the present invention may have additional embodiments, or that the present invention may be practiced without several of the details described in the following description.

Figure 1:
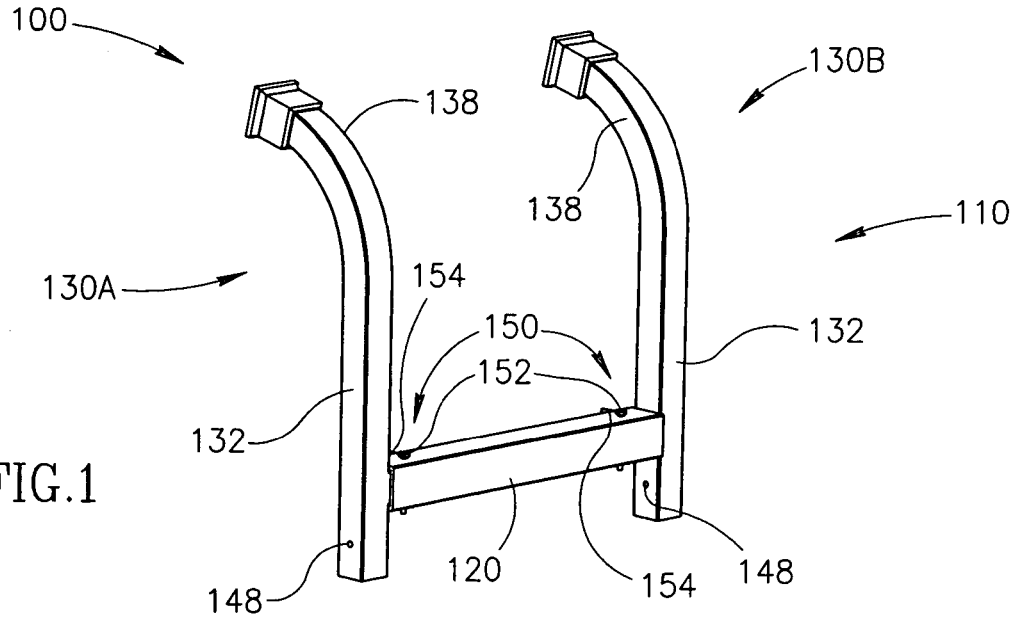
FIG. 1 is an isometric view of a ladder attachment assembly in a first operating position in accordance with an embodiment of the invention.
Figure 2:
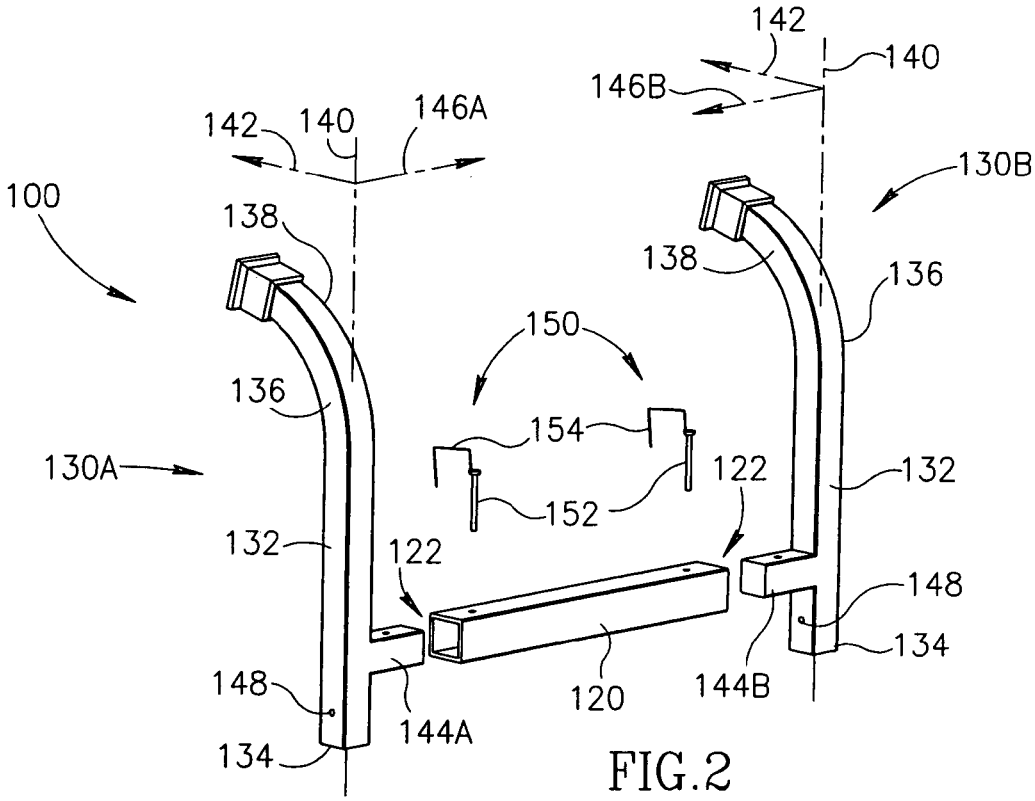
FIG. 2 is an exploded isometric view of the ladder attachment assembly of FIG. 1.
Figure 3:
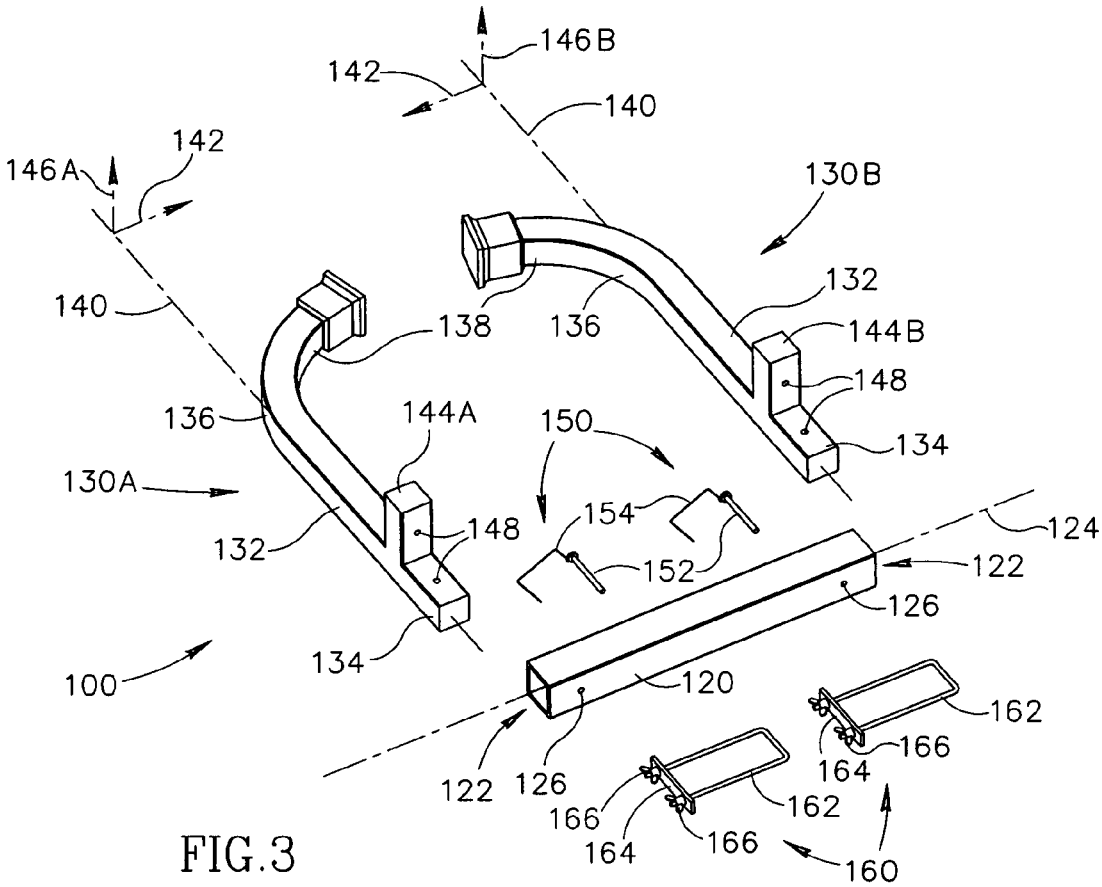
FIG. 3 is a disassembled isometric view the components of the ladder attachment assembly of FIG. 1.

FIG. 1 is a front isometric view of a ladder attachment assembly 100 in a first operating position 110 in accordance with an embodiment of the invention. FIGS. 2 and 3 are exploded isometric and disassembled views, respectively, of the ladder attachment assembly 100 of FIG. 1. As shown in FIGS. 1–3, the ladder attachment assembly 100 includes a main support 120 and first and second support modules 130A, 130B coupled to the ends of the main support 120. The first and second support modules 130A, 130B may be quickly and efficiently coupled to the main support 120 in several different operating positions, providing significant advantages over prior art attachment assemblies, as described more fully below.

As best shown in FIGS. 2 and 3, the main support 120 includes first and second open ends (or receptacles) 122 (only one visible). In this embodiment, the main support 120 is a "box beam" support so that the main support 120 and the open ends 122 have an approximately square cross-sectional shape. In alternate embodiments, however, the main support 120 may have any cross-sectional shape, including circular or any other suitable non-circular shape. Preferably, the cross-sectional shape of the receptacles 122 is a regular polygonal shape (e.g. a square). For reference purposes, a first longitudinal axis 124 extends through the main support 120.

The first and second support modules 130A, 130B are of nearly identical construction but are mirror images of each other. Each support module 130 includes an elongated support member 132 having a proximal end 134 and a distal end 136 that, in this embodiment, is curved or bent to form a support arm 138. In alternate embodiments, the support arm 138 may be a separate segment (straight or curved) that is attached to the distal end 136 of the support member 132. As shown in FIGS. 2 and 3, the support arm 138 projects outwardly away from a second longitudinal axis 140 of the support member 132 in a first direction 142. An engagement member 144 is attached to the support member 132 at a location somewhat near to but spaced apart from the proximal end 134. The engagement member 144 projects outwardly away from the second longitudinal axis 140 of the support member 132 in a second direction 146. Preferably, the first and second directions 142, 146 are orthogonal to each other and to the second longitudinal axis 140.

A pair of locking devices 150 couple the support modules 130 to the main support 120. Each locking device 150 includes a pin 152 and a retaining clip 154 pivotally coupled to a head of the pin 152. As best shown in FIG. 3, locking holes 126 are disposed through the main support 120 proximate both of the open ends 122. Corresponding locking holes 148 are disposed through the engagement members 144 and through the proximal ends 134 of the support members 132 of the support modules 130. In the first operating position 110 shown in FIG. 1, the engagement members 144 are slideably engaged into the open ends 122 of the main support 120, and the pins 152 are inserted through the locking holes 126 in the main support 120, and through the locking holes 148 in the engagement members 144. The retaining clips 154 are then snapped over the ends of the pins 152 to prevent the pins 152 from sliding out of the locking holes 126, 148.

Figure 4:
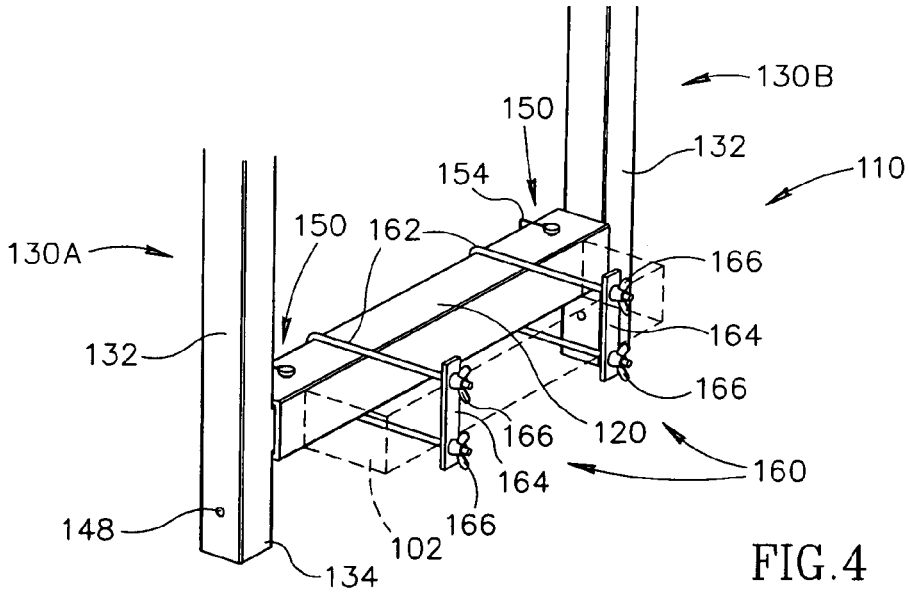
FIG. 4 is an enlarged partial isometric view of the ladder attachment assembly and attachment devices of FIG. 1.

FIG. 4 is an enlarged partial isometric view of the ladder attachment assembly 100 with a pair of attachment devices 160 mounted to the main support 120. As shown in FIGS. 3 and 4, each attachment device 160 includes a threaded bracket (or U-bolt) 162 that is engaged through a plate 164. Wing nuts 166 are threaded onto the threaded bracket 162. As further shown in FIG. 4, the attachment devices 160 are used to attach the ladder attachment assembly 100 to a rung 102 of a ladder 104 by coupling the threaded brackets 162 around the main support 120 and the rung 102, engaging the plate 164 onto the threaded bracket 162, and then installing the wing nuts 166 onto the threaded brackets 162.

Figure 14:
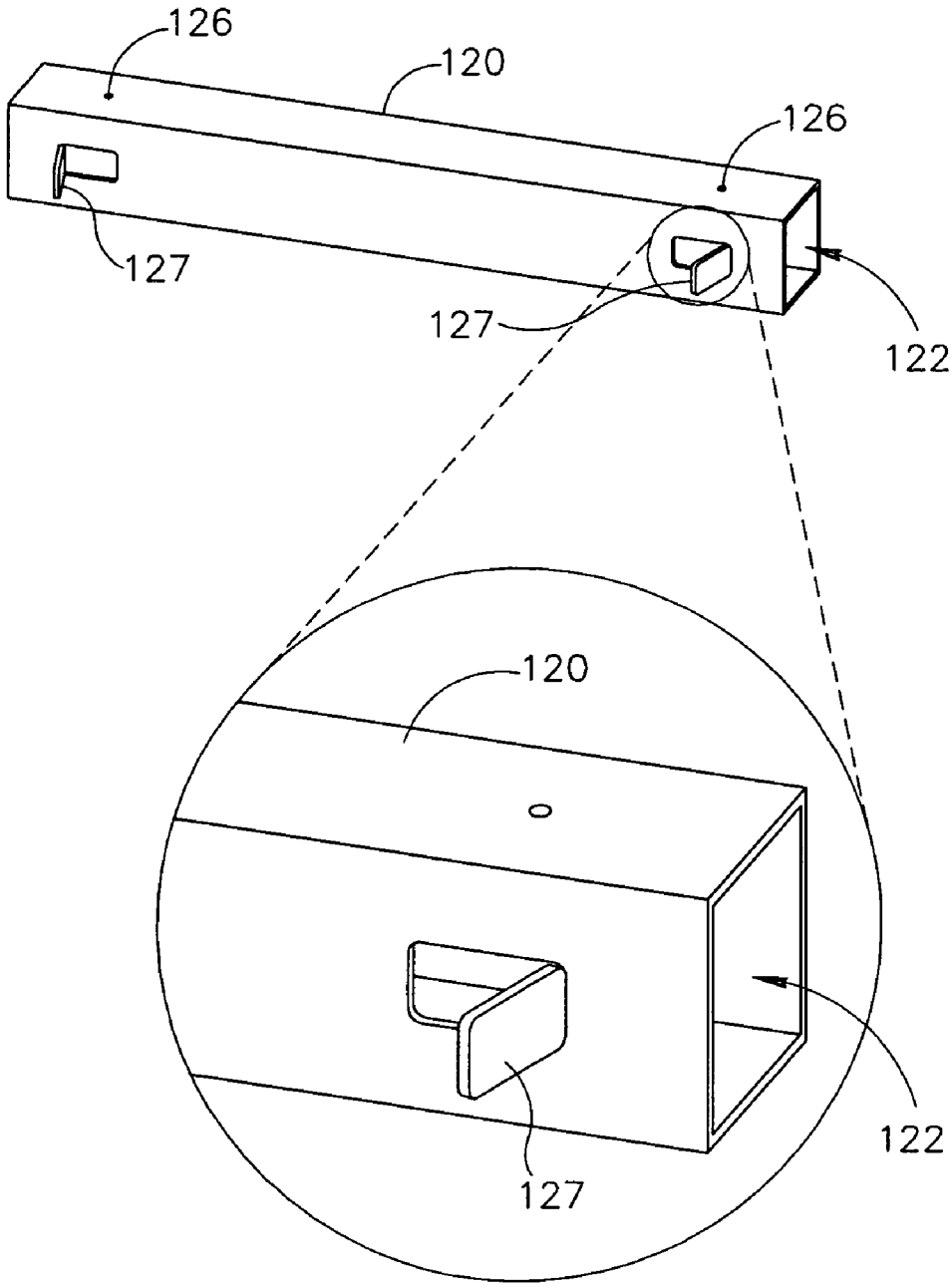
FIG. 14 is an isometric and enlarged partial isometric view of the main support of the ladder attachment assembly of FIG. 1.

Of course, a variety of attachment mechanisms may be substituted for the attachment devices 160 for attaching the main support 120 to the ladder 104, including, for example, clamps, nuts and bolts, screws, or any other suitable attachment mechanism. Alternately, the main support 120 may be integrally formed with the rung 102 of the ladder 104. In a further embodiment, the main support 120 may be attached to the rails 106 of the ladder 104 rather than (or in addition to) the rung 102). Furthermore, as shown in FIG. 14, in an alternate embodiment, the main support 120 includes a pair of brackets 127 that project outwardly from the main support 120. The brackets 127 are positioned proximate the ends of the rung 102 to engage with the rails 106 of the ladder 104. The brackets 127 help to prevent the main support 120 from sliding along the rung 102.

Figure 6:
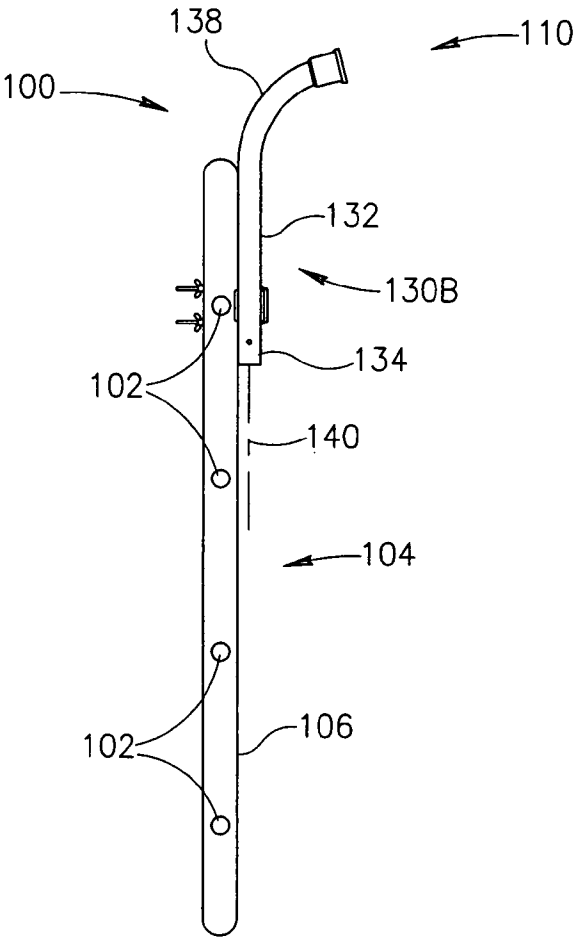
FIG. 6 is a side elevational view of the ladder attachment assembly and ladder of FIG. 5.
Figure 5:
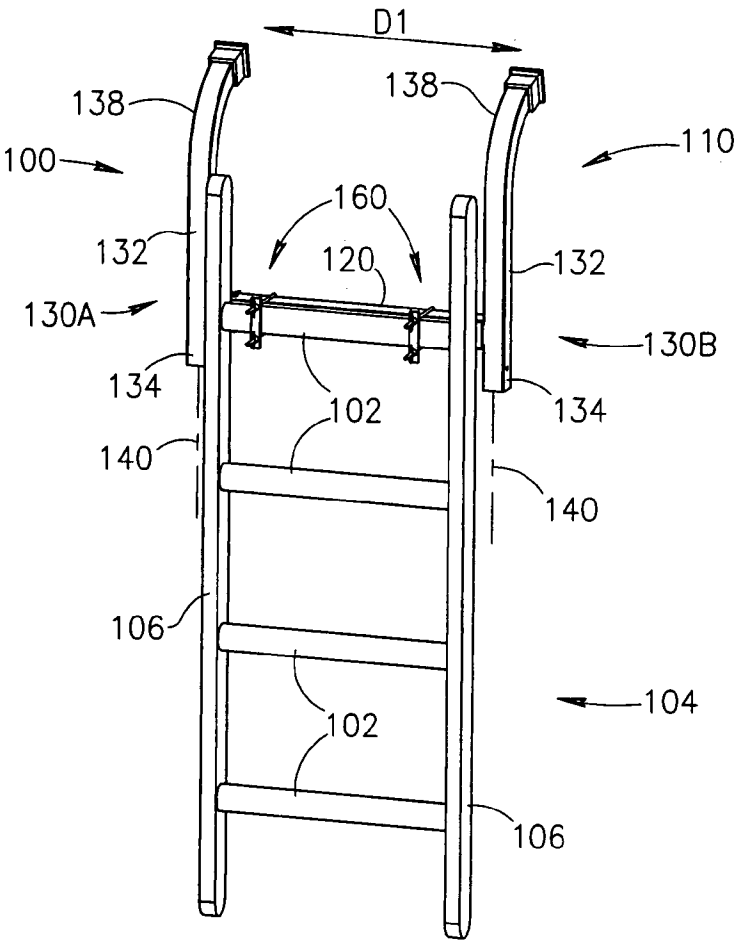
FIG. 5 is an isometric view of the ladder attachment assembly of FIG. 1 attached to a ladder in the first operating position.

FIGS. 5 and 6 are isometric and side elevational views, respectively, of the ladder attachment assembly 100 of FIG. 1 attached to the ladder 104 in the first operating position 110. The ladder 104 includes a plurality of rungs 102 extending between a pair of elongated rails 106. The main support 120 is attached to one of the rungs 102, in this case the uppermost rung 102, using the attachment devices 160 in the manner described above. As shown in FIGS. 5 and 6, in the first operating position 110, the support members 132 of the support modules 130 (specifically the second longitudinal axes 140 of the support members 132) are aligned with the rails 106. Preferably, in the first operating position 110, the support members 132 (or second longitudinal axes 140) are parallel with the rails 106 and orthogonal to the rungs 102.

As further shown in FIGS. 5 and 6, in the first operating position 110, the support members 132 extend upwardly beyond the ends of the rails 106, and the support arms 138 of the support modules 130 are spaced apart by a first distance D1. In this embodiment, the first distance D1 is slightly larger than the spacing between the rails 106 of the ladder 104. Thus, in the first position 110, the ladder attachment assembly 100 effectively extends the length of the ladder 104 and provides the support arms 138 spaced apart by the first distance D1.

Figure 7:
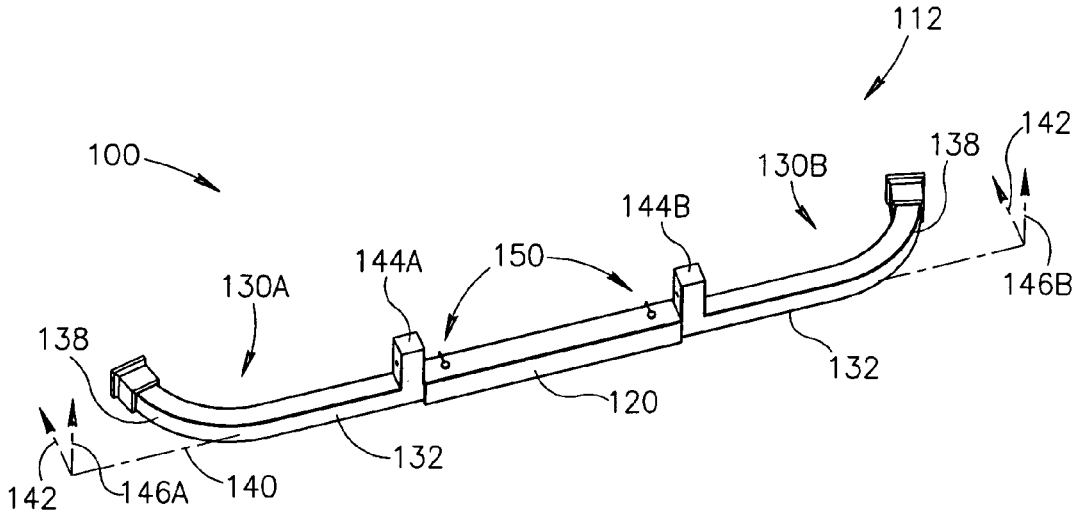
FIG. 7 is an isometric view of the ladder attachment assembly in a second operating position.
Figure 8:
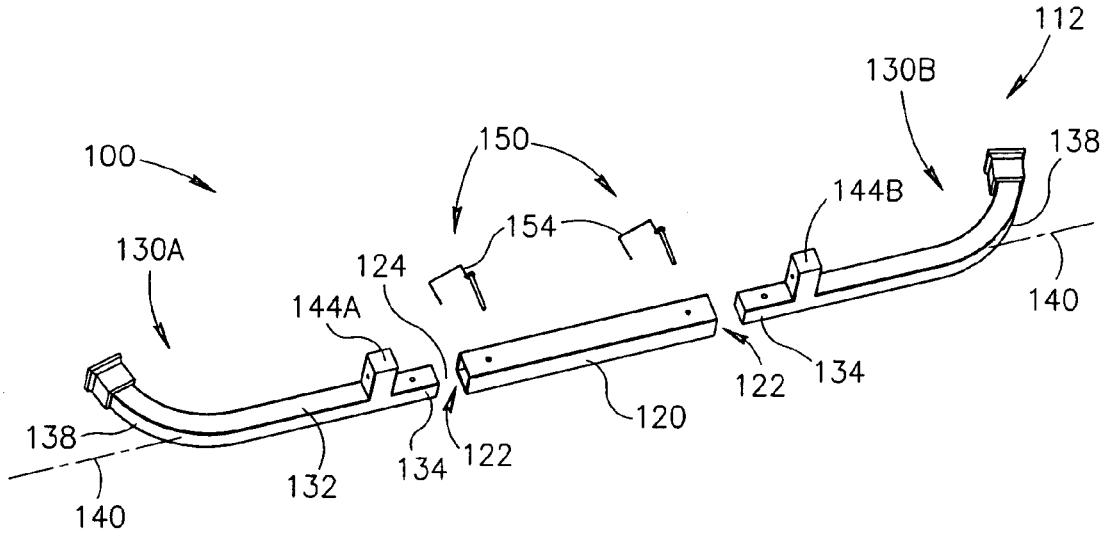
FIG. 8 is an exploded isometric view of the ladder attachment assembly of FIG. 7.

FIGS. 7 and 8 are isometric and exploded isometric views of the ladder attachment assembly 100 in a second operating position 112. In the second operating position 112, the second longitudinal axes 140 of the support members 132 are aligned with the first longitudinal axis 124 of the main support 120. As best shown in FIG. 7, the proximal ends 134 of the support members 132 are inserted into the open ends 122 of the main support 120, and the locking devices 150 are inserted through the locking holes 126 on the main support 120 and the locking holes 148 (FIG. 2) in the proximal ends 134.

Figure 10:
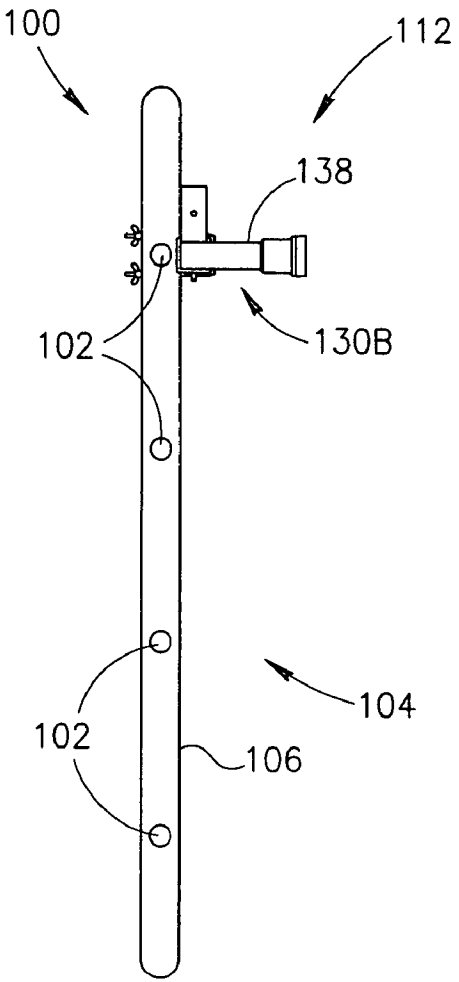
FIG. 10 is a side elevational view of the ladder attachment assembly and ladder of FIG. 9.
Figure 9:
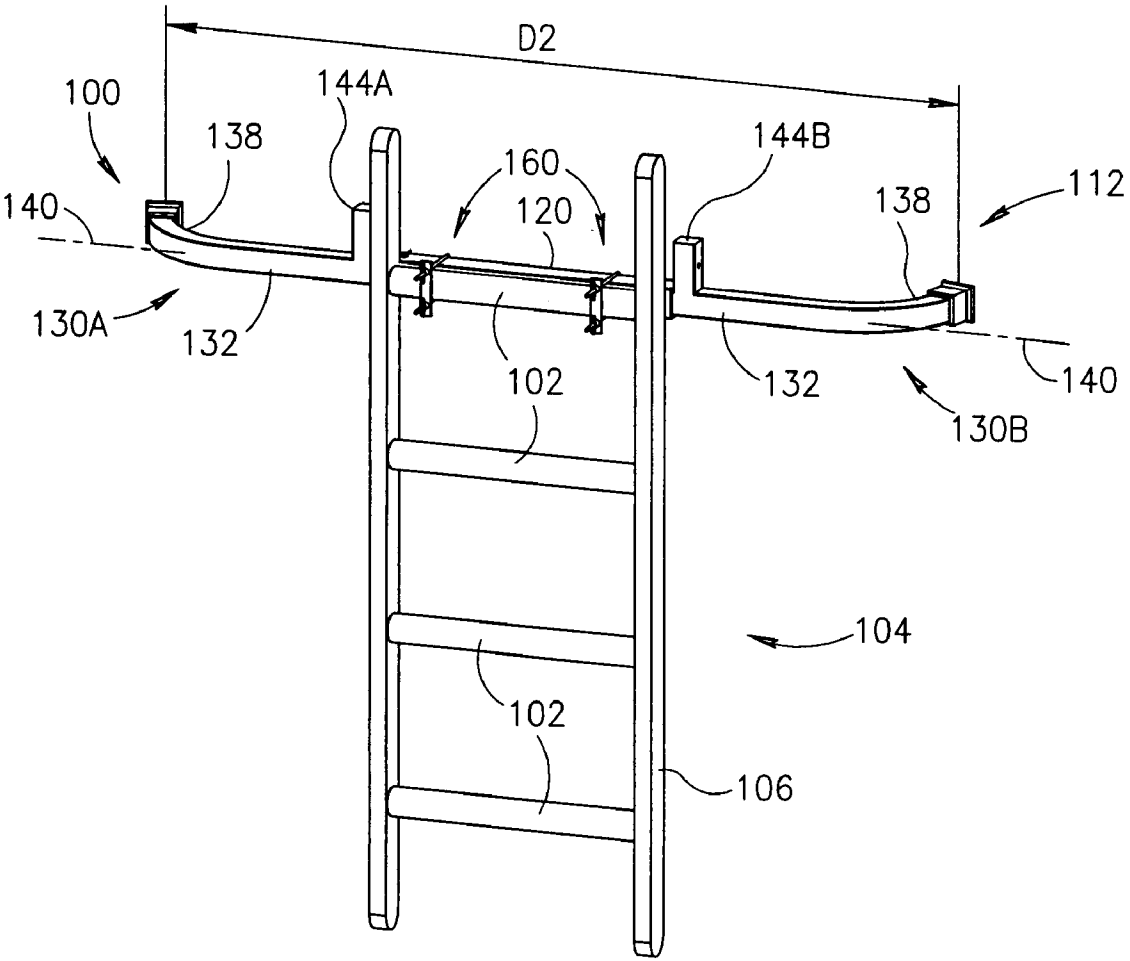
FIG. 9 is an isometric view of the ladder attachment assembly of FIG. 8 attached to a ladder in the second operating position.

FIGS. 9 and 10 are isometric and side elevational views, respectively, of the ladder attachment assembly 100 attached to the ladder 104 in the second operating position 112. Again, the main support 120 is attached to the uppermost rung 102 using the attachment devices 160. As best shown in FIG. 9, in the second operating position 112, the second longitudinal axes 140 of the support members 132 are aligned with the rung(s) 102 and are orthogonally oriented with respect to the rails 106. Also, in the second operating position 112, the support arms 138 of the support modules 130 are spaced apart by a second distance D2 that is considerably larger than the first distance D1 (FIG. 5). As further shown in FIG. 9, in the second operating position 112, the ladder attachment assembly 100 does not extend the length of the ladder 104, but rather, extends the support arms 138 outwardly from the sides of the rails 106 in a relatively widely spaced configuration having the support arms 138 separated by the second distance D2.

Figure 11:
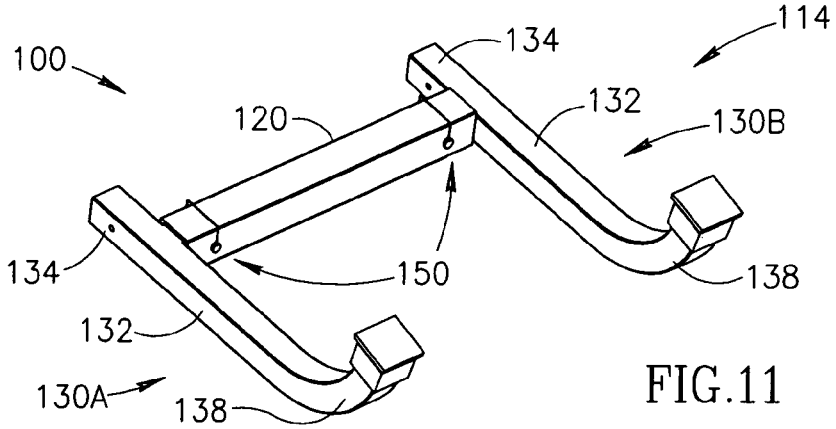
FIG. 11 is an isometric view of the ladder attachment assembly of FIG. 1 in a third operating position.

FIG. 11 is a front isometric view of the ladder attachment assembly 100 in a third operating position 114. In this position, the engagement members 144 are once again inserted into the open ends 122 of the main support 120. In the third operating position 114, however, the support members 132 extend downwardly from the main support 120 rather than upwardly, as in the first operation position 110 (FIG. 1).

Figure 12:
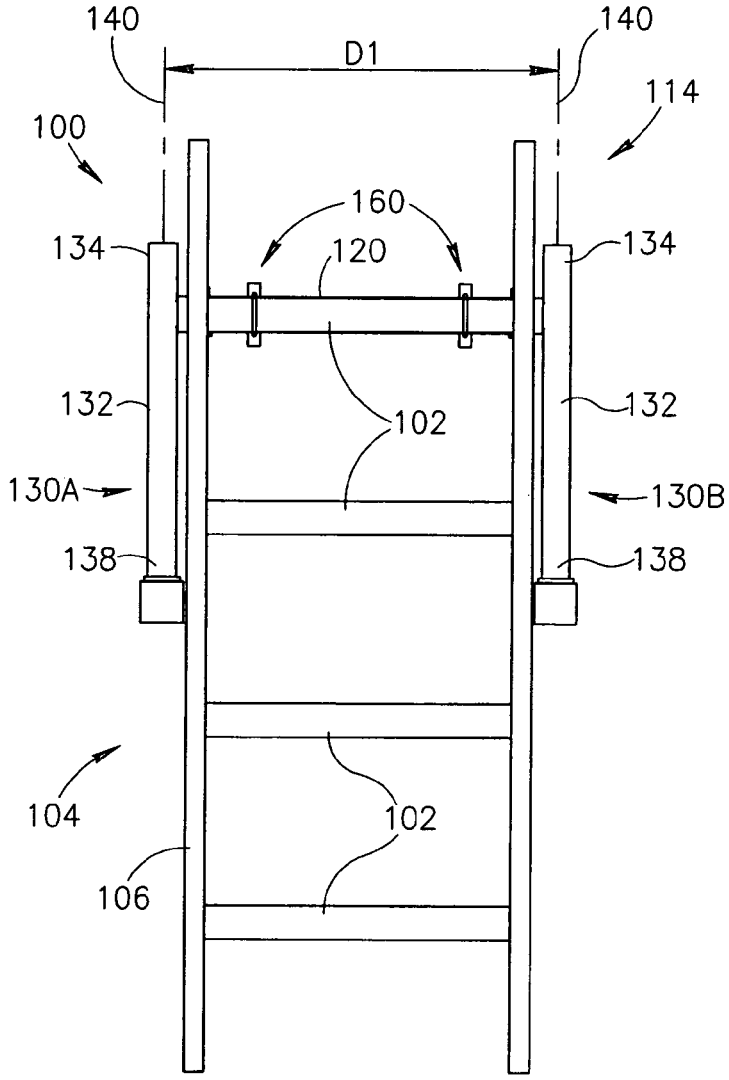
FIG. 12 is an isometric view of the ladder attachment assembly of FIG. 11 attached to a ladder in the third operating position.
Figure 13:
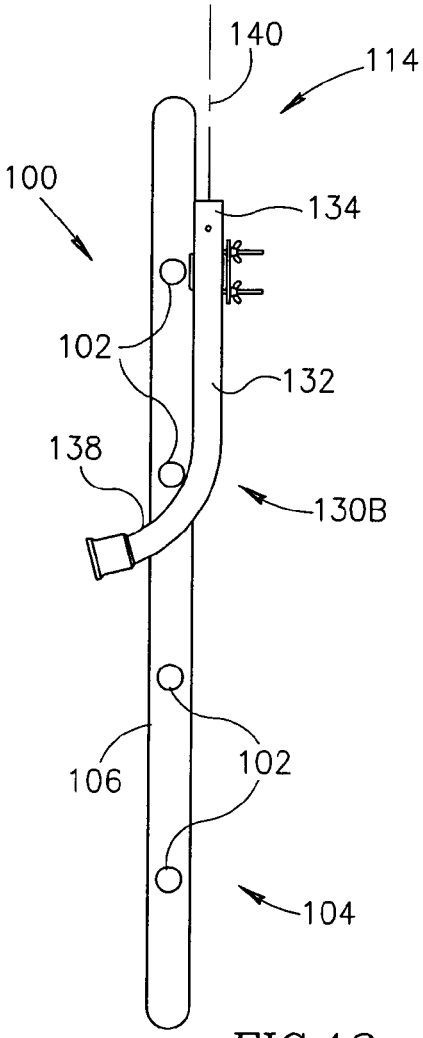
FIG. 13 is a side elevational view of the ladder attachment assembly and ladder of FIG. 12.

FIGS. 12 and 13 are isometric and side elevational views, respectively, of the ladder attachment assembly 100 attached to the ladder 104 in the third operating position 114. Again, the main support 120 is attached to the rung 102 using the attachment devices 160. As described above, in the third operating position 114, the support members 132 extend downwardly and the second longitudinal axes 140 are aligned with the rails 106 and are orthogonally oriented with respect to the rungs 102. As in the first operating position 110 (FIG. 1), the support arms 138 of the support modules 130 are spaced apart by the first distance D1 (FIG. 5), however, in the third operating position 114, the support arms 138 are positioned proximate the rails 106 in a relatively compact configuration more conducive to storage and transportation.

One may note that several alternate embodiments of the ladder attachment assembly 100 may be readily conceived. For example, in one alternate embodiment, the proximal ends 134 of the support members 132 may be eliminated so that the support modules 130 may be positioned in only the first and third operating positions 110, 114 (or removed entirely). In yet another embodiment, the engagement members 144 may be eliminated so that the support modules 130 may be coupled to the main support 120 by slideably engaging the proximal ends 134 into the receptacles 122. In further embodiments, the ends of the main support 120 may be projections, and the engagement members 144 and proximal ends 134 on the support modules 130 may be replaced with appropriate receptacles that slideably receive the projecting ends of the main support 120.

The ladder attachment assembly 100 provides several advantages over prior art apparatus for providing a standoff distance between a ladder and a wall or other support structure. First, because the support modules 130 may be coupled to the main support 120 in a variety of positions, the ladder attachment assembly 100 provides improved versatility. In the first operating position 110, for example, the support arms 138 are positioned beyond the end of the ladder 104, effectively extending the length of the ladder 104 and providing a desired standoff distance between the ends of the rails 106 and the wall. Alternately, in the second operating position 112, the support arms 138 do not extend above the ladder 104, but rather, extend outwardly from the sides of the rails 106 in a relatively wider spacing. Because the support arms 138 are spaced apart by the second distance D2 that is relatively wider than the spacing of the rails 106, the desired standoff may be provided while also improving the stability of the ladder 106. Preferably, the second distance D2 between the support arms 138 in the second operating position 112 is wide enough to extend across ordinary window openings and the like.

Furthermore, in the third operating position 114, the support members 132 project downwardly and the support arms 138 are positioned in a relatively compact configuration for transportation and storage. Finally, the support modules 130 may be removed entirely, and the ladder 106 may be used in its normal mode of operation with the main support 120 unobtrusively coupled to the rung 102. Thus, because the support modules 130 may be coupled to the main support 120 in a variety of positions, or may be removed entirely, the ladder attachment assembly 100 provides greater flexibility for reconfiguring the assembly to perform over a wide range of possible operating conditions.

The ladder attachment assembly 100 also exhibits improved operational efficiency over prior art devices. Because the engagement members 144 and the proximal ends 134 are slideably engaged into the open ends 122 of the main support 120, configuration changes may be accomplished quickly and efficiently. Furthermore, because the support modules 130 are removeably coupled to the main support 120 using simple, easily removed locking devices 150, the positions of the support modules 130 may be quickly and easily changed. There is no need to laboriously unthread bolts or screws or other relatively cumbersome attachment devices in order to change the configuration of the ladder attachment assembly 100. Therefore, the above-described changes to the operating configuration of the ladder attachment assembly 100 may be accomplished easily and efficiently.

Overall, the ladder attachment assembly 100 may provide the above-referenced operational advantages using a relatively low cost and easily maintainable apparatus. The design of the assembly is robust and resilient to wear and tear. Furthermore, the modular design of the assembly allows quick and inexpensive replacement of the main support or the support modules. Because the support arms 138 are stowable in the third operating position 114 for transportation and storage, the risk of damage to the assembly 100 may be significantly reduced.

Figure 15:
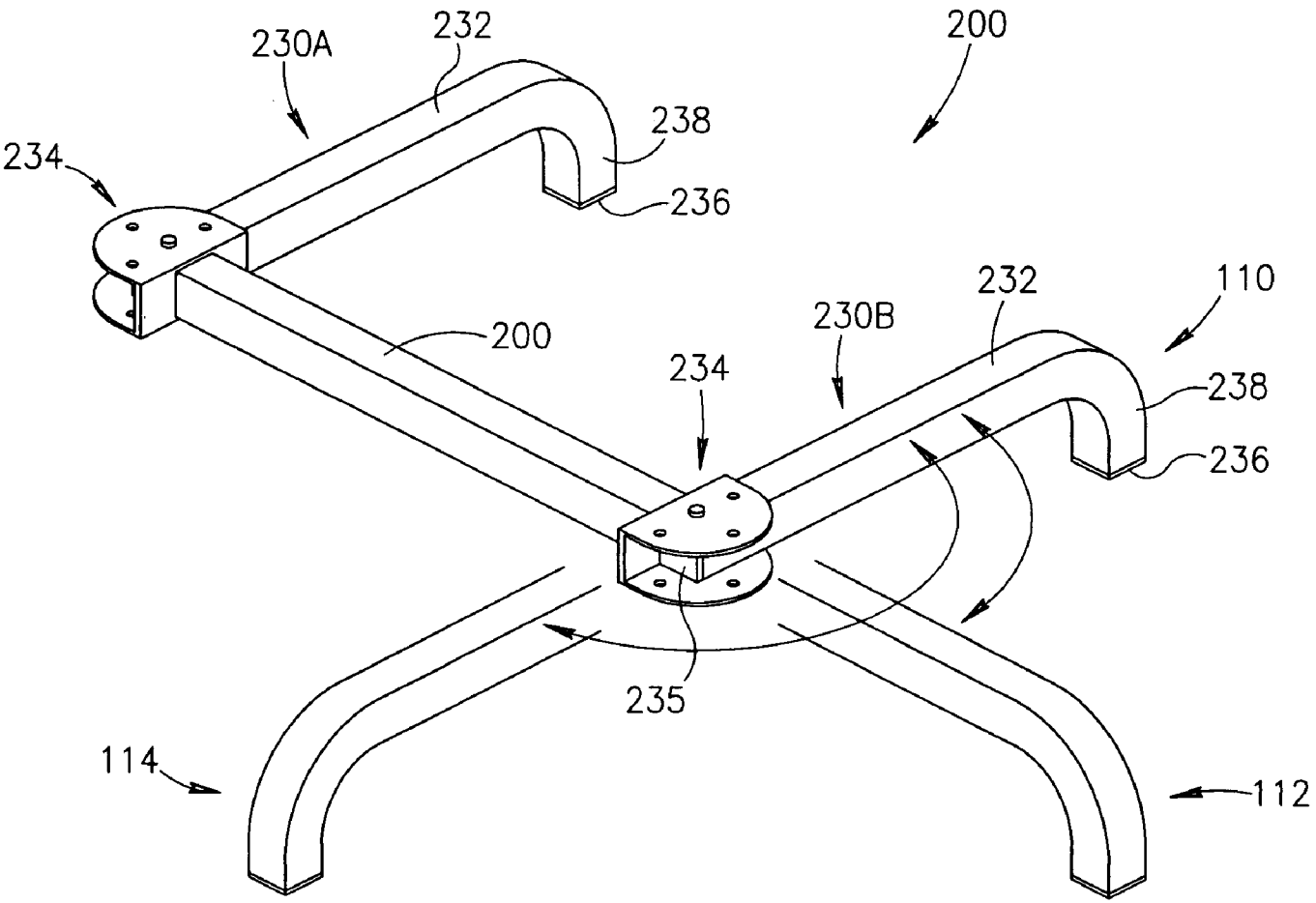
FIG. 15 is an isometric view of a ladder attachment assembly in accordance with another embodiment of the invention.

FIG. 15 is an isometric view of a ladder attachment assembly 200 in accordance with another embodiment of the invention. The ladder attachment assembly 200 includes a main support 220 and first and second support modules 230A and 230B coupled to the ends of the main support 120 by a pivotal coupler 234. As in the previous embodiment, the first and second support modules 230A and 230B are of nearly identical construction, and are mirror images of each other. Each support module 230 includes an elongated support member 232 having a proximal end 235 and a distal end 236 that, with respect to the present embodiment, is curved or bent to form a support arm 238. In other alternate embodiments, the support arm 238 may be a separate segment, which may be straight, curved, or of still other shapes that is attached to the distal end 236 of the support member 232.

Figure 16:
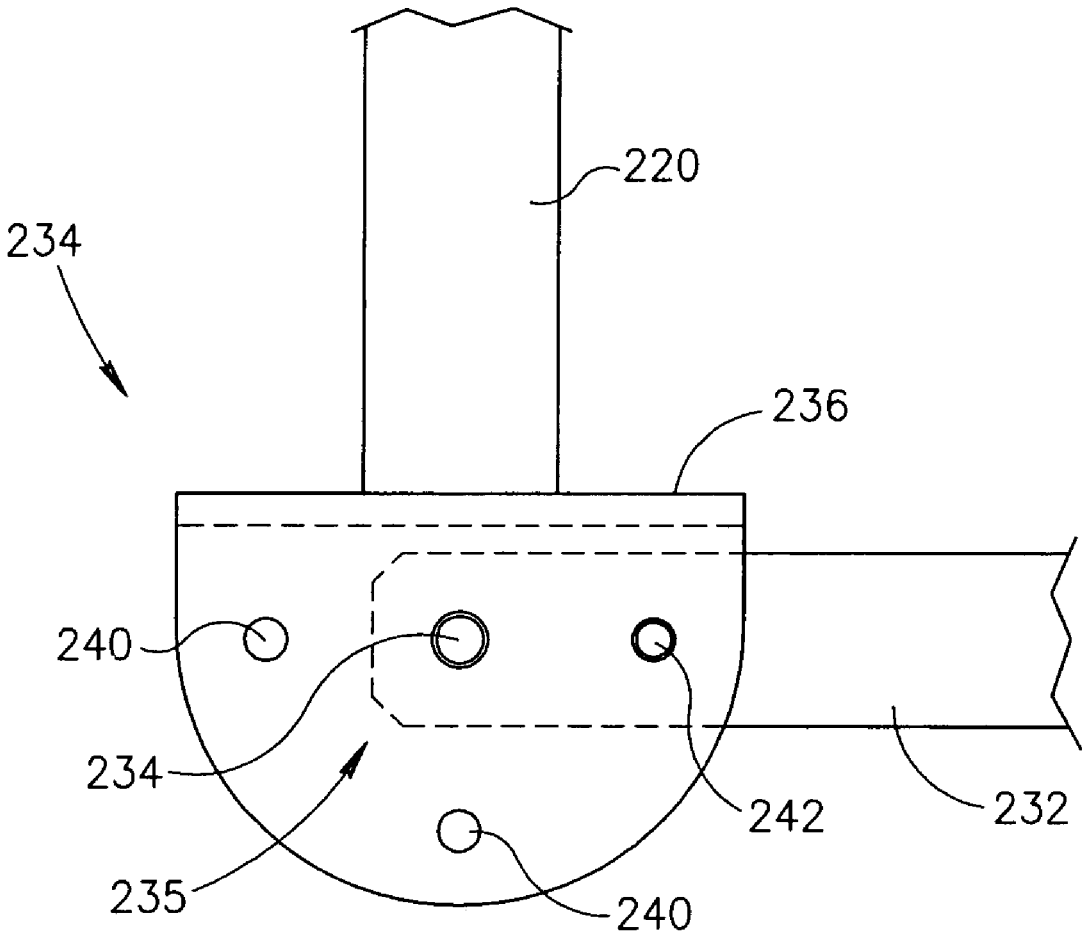
FIG. 16 is a plan view of a component of the ladder attachment assembly of FIG. 15.

Referring now to FIG. 16, a plan view of the pivotal coupler 234 of FIG. 15 is shown. The pivotal coupler 234 includes a coupler body 236 that is fixedly connected to the main support 220 that hingeably receives the proximal end 235 of the support member 232. A pin 239 extends through the coupler body 236 and also through the support member 232 to permit the support member 232 to rotate relative to the coupler body 236. The pin 239 may be retained by the coupler body 236 by deforming the ends of the pin 239 so that the pin 239 is rigidly coupled to the coupler body 236. Alternately, the pin 239 may be retained by configuring the pin 239 to receive a cotter pin (not shown), or by other similar means that are well-known in the art. The coupler body 236 also includes alignment holes 240 that project through the coupler body 236 that are configured to removably receive a locking device 242 that includes a pin and a retaining clip (not shown) that couples to a portion of the pin.

Referring now to FIGS. 15 and 16, the alignment holes 240 are suitably positioned in the coupler body 236 to permit the locking device 242 to lock the support member 232 in a desired position. As best shown in FIG. 15, the support member 232 may be positioned in the first operating position 110, as described more fully in connection with the previous embodiment. Alternately, the support member 232 may also be positioned in either of the second operating position 112, or the third operating position 114, as earlier described. Additionally, the ladder attachment assembly 200 may be readily configured so that the support members 232 may assume other operating positions. For example, one of the support members 232 may be positioned in the first operating position 110, while the opposite support member 232 is positioned in the second operating position 112.

Figure 17:
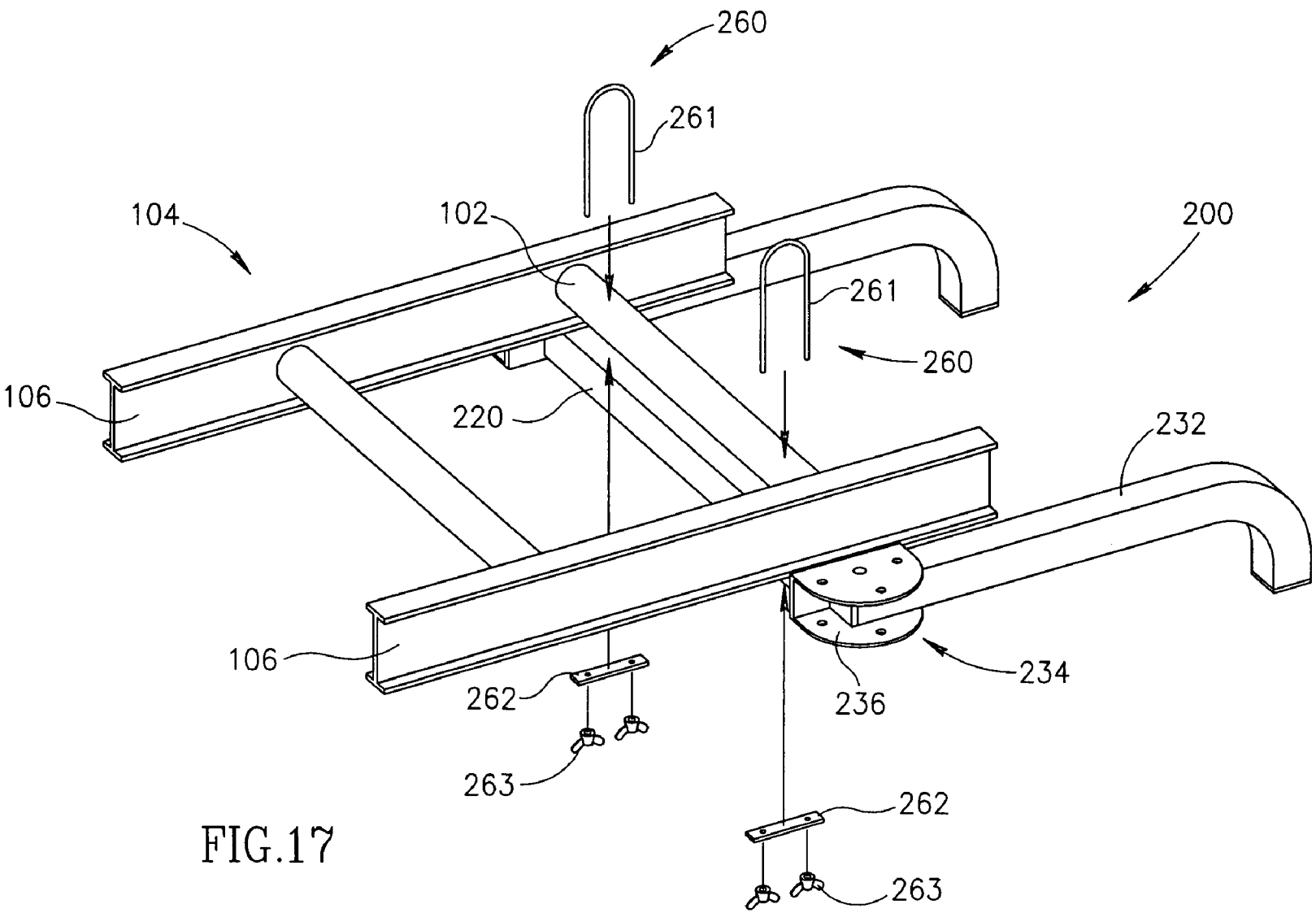
FIG. 17 is a partial isometric view of the ladder attachment assembly of FIG. 15 attached to the ladder.

FIG. 17 is a partial isometric view of the ladder attachment assembly 200 attached to the ladder 104 with a pair of attachment devices 260 mounted to the main support 220. As shown therein, the main support 220 has a length that permits the ladder 104 to be positioned between the pivotal couplers 234 positioned on opposing ends of the main support 220. Each attachment device 260 may include a U-bolt 261 that is engaged through a plate 262. Wing nuts 263 are threadably received by the U-bolt 261 so that the ladder attachment assembly 200 may be fixedly secured to the rung 102 of the ladder 104 by positioning the U-bolts 261 around the main support 220 and the rung 102, placing the plates 262 on the U-bolts 261 and installing the wing nuts 263 onto the U-bolts 261. Although the foregoing attachment devices 260 permits the ladder attachment assembly 200 to be removably attached to the ladder 104, in another related embodiment, the main support 220 may be integrally formed with the rung 102 of the ladder 104. In yet another related embodiment, the main support 120 may be attached to the rails 106 of the ladder 104 rather than to the rung 102, and may also be optionally attached to both the rails 106 and the rung 102.

The ladder attachment assembly 200 provides still further advantages over the prior art. For example, since the support modules 230 are rotatably coupled to the main support 220, the ladder attachment assembly 200 does not require disassembly in order to configure the assembly 200 into the various operating positions. Further, since the assembly 200 is generally a one-piece assembly, the loss or misplacement of component parts of the assembly 200 is advantageously avoided.

Figure 18:
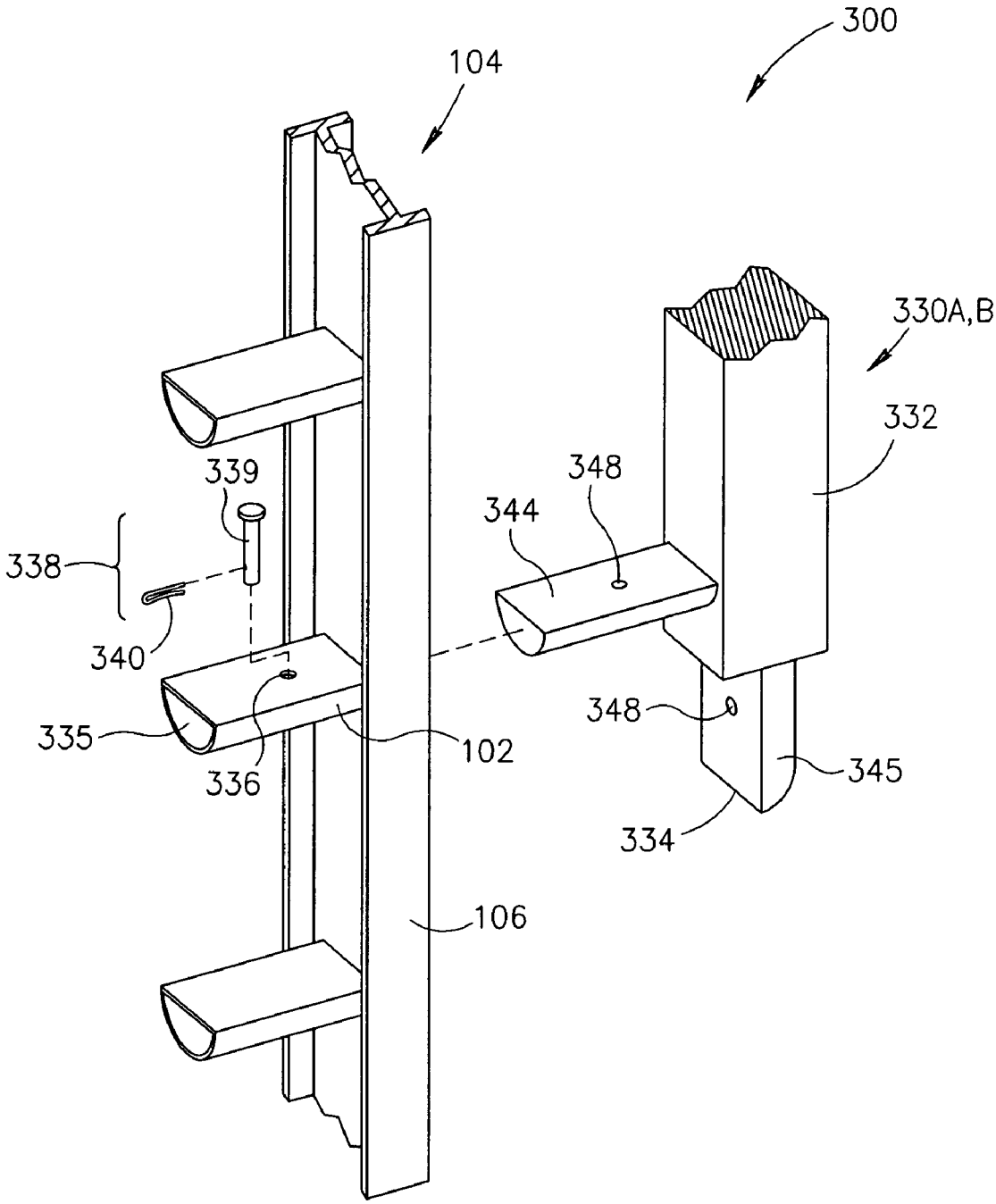
FIG. 18 is a partial isometric view of a ladder attachment assembly in accordance with still another embodiment of the invention.

FIG. 18 is a partial isometric view of a ladder attachment assembly 300 in accordance with still another embodiment of the invention. The ladder attachment assembly 300 includes first and second support modules 330A and 330B that are generally identical to the support modules 130A and 130B shown in FIG. 1. Accordingly, in the interest of brevity, certain details of the first and second support modules 330A and 330B not shown in FIG. 18 will not be described further. The first and second support modules 330A and 330B further include support members 332. Each support member 332 includes a first engagement member 344 that is configured to be slidably received by an interior recess 335 within the rung 102 of the ladder 104. The proximal end 334 of each support member 332 also includes a second engagement member 345 that is similarly configured to be slidably received by the interior recess 335 of the rung 102. The first engagement member 344 and the second engagement member 345 further include locking holes 348 that project through the first engagement member 344 and the second engagement member 345 that are suitably positioned to align with a hole 336 that extends through the rung 102 when either the first engagement member 344 or the second engagement member 345 is positioned within the interior recess 335. A locking device 338 that includes a pin 339 and a retaining clip 340 may be inserted through the holes 336 in the rung and through the locking holes 348 to lockably couple the support members 332 to the ladder 102.

Still referring to FIG. 18, to configure the ladder attachment assembly 300 in the first operating position 110 (as shown in FIG. 5), the first engagement member 344 is positioned within the interior recess 335 of the rung 102 and the locking device 338 is positioned through the rung 102 and the first engagement member 344. Correspondingly, the ladder attachment assembly 300 may also be configured in the second operating position 112 (as shown in FIG. 9) by positioning the second engagement member 345 within the interior recess 335 of the rung 102.

Figure 19:
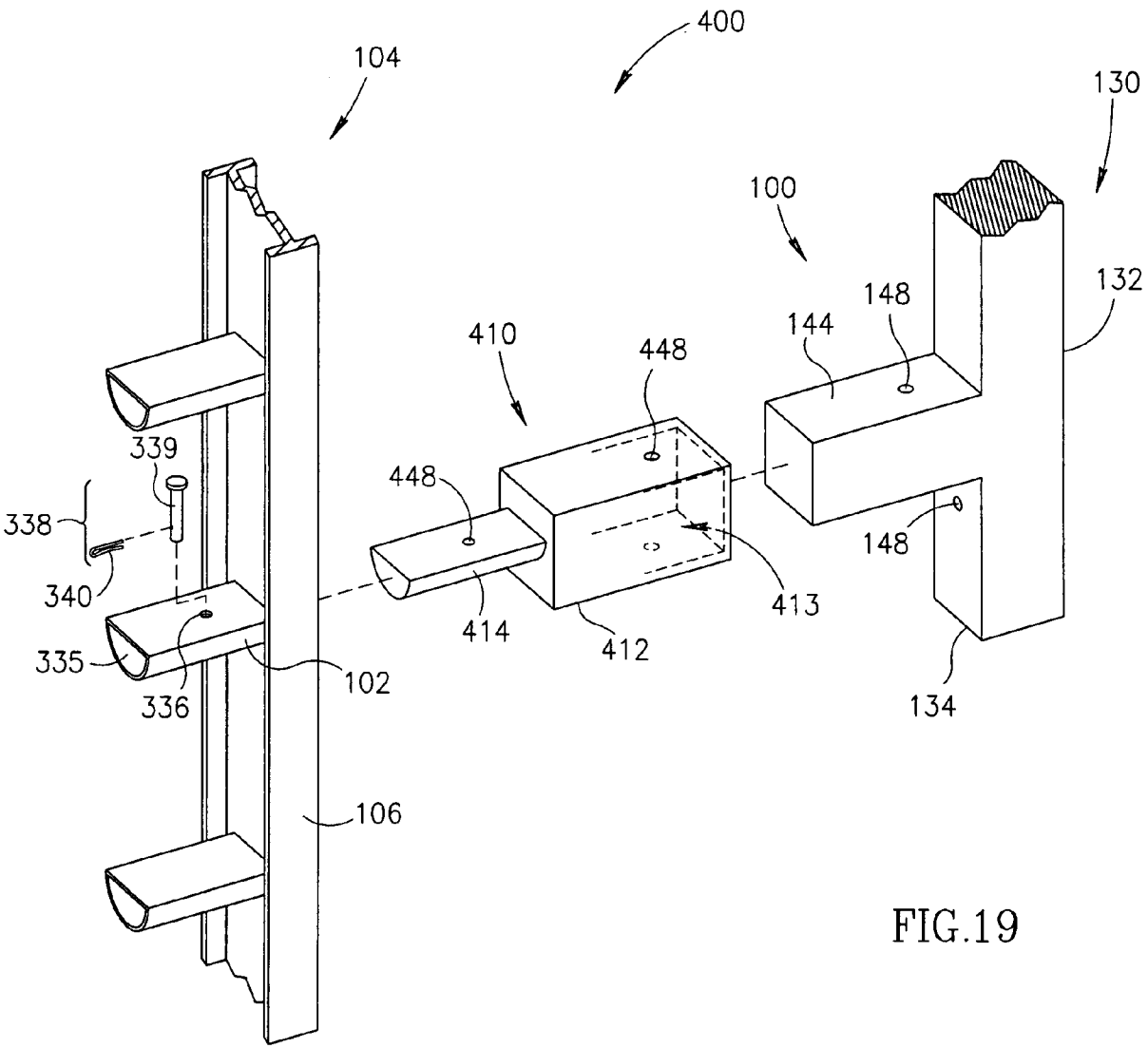
FIG. 19 is a partial isometric view of a ladder attachment assembly in accordance with still yet another embodiment of the invention.

FIG. 19 is a partial isometric view of a ladder attachment assembly 400 in accordance with still yet another embodiment of the invention. The ladder attachment assembly 400 includes first and second support modules 130A and 130B as shown in FIG. 1. Again, in the interest of brevity, the various details of the first and second support modules 130A and 130B will not be described further. Additionally, various details of the ladder 102 are also identical to those shown in FIG. 18, and accordingly will not be described further. The ladder attachment assembly 400 further includes an adaptor 410 having a forward engagement member 414 that is configured to be slidably received by the interior recess 335 of the rung 102. The adaptor 410 further includes an engagement recess 413 that is configured to slidably receive the engagement member 144 of the support member 132.

Locking holes 448 project through the engagement recess 413 that align with the locking holes 148 in the engagement member 144 that permit the locking device 150 (as shown in FIG. 3) to lockably engage the adaptor 410 to the engagement member 144. Locking holes 448 also project through the forward engagement member 414 that align with the locking holes 336 in the rung 102 of the ladder 104 so that the locking device 338 lockably engages the forward engagement member 414 to the rung 102.

Referring still to FIG. 19, following the insertion of the forward engagement member 414 of the adaptor 410 into the recess 335, and following locking the adaptor 410 in place, the ladder attachment assembly 400 may be readily configured in the first operating position 110 (as shown in FIG. 5), the second operating position 112 (as shown in FIG. 9), or the third operating position 114 (as shown in FIG. 12).

The detailed descriptions of the above embodiments are not exhaustive descriptions of all embodiments contemplated by the inventors to be within the scope of the invention. Indeed, persons skilled in the art will recognize that certain elements of the above-described embodiments may variously be combined or eliminated to create further embodiments, and such further embodiments fall within the scope and teachings of the invention. It will also be apparent to those of ordinary skill in the art that the above-described embodiments may be combined in whole or in part to create additional embodiments within the scope and teachings of the invention.

Thus, although specific embodiments of, and examples for, the invention are described herein for illustrative purposes, various equivalent modifications are possible within the scope of the invention, as those skilled in the relevant art will recognize. The teachings provided herein can be applied to other ladder attachment apparatus and methods, and not just to the embodiments described above and shown in the accompanying figures. Accordingly, the scope of the invention should be determined from the following claims.

What is claimed is:

1. An attachment apparatus for a ladder having a plurality of rungs extending between a pair of elongated rails, comprising:

a main support adapted to be coupled to the ladder approximately parallel to the rungs and having a first coupling member adapted to be proximate a first one of the elongated rails and a second coupling member adapted to be proximate another one of the elongated rails; and first and second support modules, each support module having an elongated support member including a proximal end and a distal end and a support arm projecting outwardly therefrom in a first direction, the support arm being attached to the support member proximate the distal end, each support module removeably coupleable with at least one of the coupling members to position the support member in a first position in which a first longitudinal axis thereof is approximately aligned with a second longitudinal axis of the main support and each support module removeably coupleable with at least one of the coupling members such that the first longitudinal axis of the support member is approximately orthogonal to the second longitudinal axis of the main support.

2. The apparatus according to claim 1 wherein the proximal end comprises a first projecting portion, the first projecting portion being removeably coupleable with the at least one of the coupling members to position the support member in the first position.

3. The apparatus according to claim 2 wherein the support member of each support module comprises an engagement arm having a second projecting portion that is removeably coupleable with the at least one of the coupling members to position the support member in the second position.

4. The apparatus according to claim 3 wherein the engagement arm is attached to the support member at a location spaced apart from the proximal end and projecting outwardly therefrom in a second direction that is approximately orthogonal to the first longitudinal axis of the support member.

5. The apparatus according to claim 3 wherein at least one of the first and second coupling members comprises a receptacle, and wherein at least one of the first and second projecting portions is slideably engageable with the at least one of the first and second coupling members.

6. The apparatus according to claim 3 wherein at least one of the first and second coupling members comprises a non-circular receptacle and wherein at least one of the projecting portions is slideably engageable within the non-circular receptacle.

7. The apparatus according to claim 1 wherein the proximal end of each support module comprises a first projecting portion slideably engageable with the at least one coupling member to position the support member in the first position; and, further comprising an engagement arm attached to the support member at a location spaced apart from the proximal end and projecting outwardly therefrom in a second direction, the engagement arm comprising a second projecting portion slideably engageable with the at least one coupling member to position the support member in the second position.

8. The apparatus according to claim 1 wherein the main support is adapted to be coupled to a rung of the ladder.

9. The apparatus according to claim 1, further comprising at least one securing mechanism including a locking pin securing each support module to the main support.

10. An attachment apparatus for a ladder having a plurality of rungs extending between a pair of elongated rails, comprising:

a main support adapted to be coupled to the ladder approximately parallel to the rungs and having a first coupling member proximate a first one of the elongated rails and a second coupling member proximate another one of the elongated rails;

a first support module removeably coupleable to the first coupling member and a second support module removeably coupleable to the second coupling member, each support module having a support member including a proximal end and a distal end, and a support arm attached to the support member proximate the distal end and projecting outwardly therefrom in a first direction, the proximal end of the support member being removeably coupleable to a corresponding one of the first and second coupling members in a first position wherein the support member is approximately aligned with the main support; and wherein each support module further includes an engagement arm attached to the support member, the engagement arm being removeably coupleable to the corresponding one of the first and second coupling members in a second position wherein the support member is approximately orthogonal to the main support.

11. The apparatus according to claim 10 wherein the engagement arm of each support module is attached to the support member at a location spaced apart from the proximal end and projecting outwardly therefrom in a second direction.

12. The apparatus according to claim 10 wherein in the second position, the support member is approximately orthogonal to the main support and the support arm projects outwardly toward a first side of the main support, and wherein the engagement arm is further removeably coupleable to the corresponding one of the first and second coupling members in a third position wherein the support member is approximately orthogonal to the main support and the support arm projects outwardly toward a second side of the main support.

13. The apparatus according to claim 10 wherein at least one of the first and second coupling members comprises a receptacle and wherein the proximal end of the support member of each support module is slideably engageable within the receptacle.

14. An assembly, comprising: a ladder having a plurality of rungs extending between a pair of elongated rails; an attachment assembly coupled to the ladder, comprising a main support coupled to the ladder approximately parallel to the rungs and having a first coupling member proximate a first one of the elongated rails and a second coupling member proximate another one of the elongated rails; and first and second support modules, each support module having an elongated support member including a proximal end and a distal end and a support arm projecting outwardly therefrom in a first direction, the support arm being attached to the support member proximate the distal end, each support module removeably coupleable with at least one of the coupling members to position the support member in a first position in which a first longitudinal axis of the support member is approximately aligned with a second longitudinal axis of the main support and each support module removeably coupleable with at least one of the coupling members to position the support member in a second position in which the first longitudinal axis thereof is approximately orthogonal to the second longitudinal axis of the main support.

15. The assembly according to claim 14 wherein the proximal end comprises a first projecting portion, the first projecting portion being removeably coupleable with the at least one of the coupling members to position the support member in the first position.

16. The assembly according to claim 15 wherein the support member of each support module comprises an engagement arm having a second projecting portion that is removeably coupleable with the at least one of the coupling members to position the support member in the second position.

17. The assembly according to claim 16 wherein the engagement arm is attached to the support member at a location spaced apart from the proximal end and projecting outwardly therefrom in a second direction that is approximately orthogonal to the first longitudinal axis of the support member.

18. The assembly according to claim 16 wherein at least one of the first and second coupling members comprises a receptacle, and wherein at least one of the first and second projecting portions is slideably engageable with the at least one of the first and second coupling members.

19. The assembly according to claim 14 wherein the proximal end of each support module comprises a first projecting portion slideably engageable with the at least one coupling member to position the support member in the first position; and, further comprising an engagement arm attached to the support member at a location spaced apart from the proximal end and projecting outwardly therefrom in a second direction, the engagement arm comprising a second projecting portion slideably engageable with the at least one coupling member to position the support member in the second position.

20. A method of stabilizing a ladder having a plurality of rungs extending between a pair of elongated rails, comprising:

coupling a main support to the ladder approximately parallel to the rungs, the main support having a first coupling member proximate a first one of the elongated rails and a second coupling member proximate another one of the elongated rails;

removeably coupling first and second support modules to the first and second coupling members, respectively, each support module having an elongated support member and a support arm projecting outwardly therefrom in a first direction, the support member having at least one projecting portion removeably coupled with at least one of the first and second coupling members of the main support;

stabilizing the ladder using the first and second support modules; and decoupling the first and second support modules from the first and second coupling members while the main support is coupled to the ladder.

21. The method according to claim 20 wherein each elongated support member includes a proximal end and a distal end, the support arm being attached to the support member proximate the distal end, and wherein removeably coupling first and second support modules to the first and second coupling members comprises slideably engaging the proximal ends of the support members with the coupling members.

22. The method according to claim 20 wherein the elongated support member includes a proximal end and a distal end, the support arm being attached to the support member proximate the distal end, and wherein the projecting portion comprises an engagement arm attached to the support member at a location spaced apart from the proximal end and projecting outwardly therefrom in a second direction, and wherein removeably coupling the first and second support modules to the first and second coupling members comprises slideably engaging the engagement arms of the support members with the coupling members.

23. The method according to claim 20 wherein each elongated support member includes a proximal end and a distal end, the support arm being attached to the support member proximate the distal end, and wherein the proximal end comprises a first projecting portion, further comprising an engagement arm attached to the support member at a location spaced apart from the proximal end and projecting outwardly therefrom in a second direction, and wherein removeably coupling the first and second support modules to the first and second coupling members comprises at least one of slideably engaging the proximal ends of the support members with the coupling members and slideably engaging the engagement arms of the support members with the coupling members.

* * * * *

UNITED STATES PATENT AND TRADEMARK OFFICE

CERTIFICATE OF CORRECTION

PATENT NO. : 6,997,283 B2
APPLICATION NO. : 10/734736
DATED : February 14, 2006
INVENTOR(S) : Skye Lechner Wollenberg and Neil Garrett Stockman It is certified that error appears in the above-identified patent and that said Letters Patent is hereby corrected as shown below:

| Column, Line | Reads | Should read |
|---|---|---|
| Column 4, Line 46 | "to) the rung **102**)." | --to) the rung **102**.-- |
| Column 5, Line 46 | "in the first operation position" | --in the first operating position-- |
| Column 9, Lines 48-62 | "first and second support modules, each support module having an elongated support member including a proximal end and a distal end and a support arm projecting outwardly therefrom in a first direction, the support arm being attached to the support member proximate the distal end, each support module removeably coupleable with at least one of the | --first and second support modules, each support module having an elongated support member including a proximal end and a distal end and a support arm projecting outwardly therefrom in a first direction, the support arm being attached to the support member proximate the distal end, each support module removeably coupleable with at least one of the |

UNITED STATES PATENT AND TRADEMARK OFFICE

CERTIFICATE OF CORRECTION

PATENT NO. : 6,997,283 B2
APPLICATION NO. : 10/734736
DATED : February 14, 2006
INVENTOR(S) : Skye Lechner Wollenberg and Neil Garrett Stockman It is certified that error appears in the above-identified patent and that said Letters Patent is hereby corrected as shown below:

| Column, Line | Reads | Should read |
|---|---|---|
| | coupling members to position the support member in a first position in which a first longitudinal axis thereof is approximately aligned with a second longitudinal axis of the main support and each support module removably coupleable with at least one of the coupling members such that the first longitudinal axis of the support member is approximately orthogonal to the second longitudinal axis of the main support." | coupling members to position the support member in a first position in which a first longitudinal axis thereof is approximately aligned with a second longitudinal axis of the main support, and each support module removably coupleable with at least one of the coupling members to position the support member in a second position in which the first longitudinal axis thereof is approximately orthogonal to the second longitudinal axis of the |

UNITED STATES PATENT AND TRADEMARK OFFICE

CERTIFICATE OF CORRECTION

PATENT NO. : 6,997,283 B2
APPLICATION NO. : 10/734736
DATED : February 14, 2006
INVENTOR(S) : Skye Lechner Wollenberg and Neil Garrett Stockman It is certified that error appears in the above-identified patent and that said Letters Patent is hereby corrected as shown below:

| Column, Line | Reads | Should read |
|---|---|---|
| | | main support-- |
| Column 10, Line 27 | "and, further comprising" | --and further comprising-- |
| Column 11, Lines 27-42 | "first and second support modules, each support module having an elongated support member including a proximal end and a distal end and a support arm projecting outwardly therefrom in a first direction, the support arm being attached to the support member proximate the distal end, each support module removeably coupleable with at least one of the coupling members to | --first and second support modules, each support module having an elongated support member including a proximal end and a distal end and a support arm projecting outwardly therefrom in a first direction, the support arm being attached to the support member proximate the distal end, each support module removeably coupleable with at least one of the coupling members to |

UNITED STATES PATENT AND TRADEMARK OFFICE

CERTIFICATE OF CORRECTION

PATENT NO. : 6,997,283 B2
APPLICATION NO. : 10/734736
DATED : February 14, 2006
INVENTOR(S) : Skye Lechner Wollenberg and Neil Garrett Stockman It is certified that error appears in the above-identified patent and that said Letters Patent is hereby corrected as shown below:

| Column, Line | Reads | Should read |
|---|---|---|
| | position the support member in a first position in which a first longitudinal axis of the support member is approximately aligned with a second longitudinal axis of the main support and each support module removeably coupleable with at least one of the coupling members to position the support member in a second position in which the first longitudinal axis thereof is approximately orthogonal to the second | position the support member in a first position in which a first longitudinal axis thereof is approximately aligned with a second longitudinal axis of the main support, and each support module removeably coupleable with at least one of the coupling members to position the support member in a second position in which the first longitudinal axis thereof is approximately orthogonal to the second longitudinal axis of the |

UNITED STATES PATENT AND TRADEMARK OFFICE

CERTIFICATE OF CORRECTION

PATENT NO. : 6,997,283 B2
APPLICATION NO. : 10/734736
DATED : February 14, 2006
INVENTOR(S) : Skye Lechner Wollenberg and Neil Garrett Stockman It is certified that error appears in the above-identified patent and that said Letters Patent is hereby corrected as shown below:

| Column, Line | Reads | Should read |
|---|---|---|
| | longitudinal axis of the main support." | main support.-- |
| Column 12, Line 3 | "position; and, further" | --position; and further-- |

Signed and Sealed this

Twenty Second Day of April, 2008

JON W. DUDAS
*Director of the United States Patent and Trademark Office*